US005749405A

United States Patent [19]

Huang

[11] Patent Number: 5,749,405

[45] Date of Patent: May 12, 1998

[54] OPERATING DEVICE FOR A VENETIAN BLIND TO CONTROL RAISING AND LOWERING OF THE SALTS AND TO ADJUST TILTING ANGLE OF THE SLATS

[76] Inventor: Tai-Long Huang, No. 382, Sec. 1, Yuan-Lu Rd., Fu-Hsing Hsiang, Chang Hua Hsien, Taiwan

[21] Appl. No.: 844,406

[22] Filed: Apr. 18, 1997

[51] Int. Cl.[6] ..... E06B 9/30

[52] U.S. Cl. ..... 160/168.1 R; 160/176.1 R; 160/178.2 R

[58] Field of Search ..... 160/168.1 R, 173 R, 160/176.1 R, 177 R, 178.1 R, 178.2 R, 107, 172 R, 171 R, 170 R

[56] References Cited

U.S. PATENT DOCUMENTS

| | | | |
|---|---|---|---|
| 5,465,775 | 11/1995 | Biba et al. | 160/178.1 R X |
| 5,472,035 | 12/1995 | Biba et al. | 160/168.1 R |
| 5,501,262 | 3/1996 | Inaba et al. | 160/173 R X |
| 5,553,649 | 9/1996 | Chisaka et al. | 160/178.2 R X |
| 5,553,653 | 9/1996 | Rozon | 160/178.1 R X |
| 5,645,685 | 7/1997 | Furhman | 160/168.1 R |

*Primary Examiner*—David M. Purol
*Attorney, Agent, or Firm*—Ladas & Parry

[57] ABSTRACT

An operating device for a Venetian blind includes a rotary tilt control unit which is adapted to be coupled to a shaft of the Venetian blind so as adjust tilting angles of slats. A positioning tube is connected to the tilt control unit and has a top opening and an axially extending slot. A retaining member is axially movable in the positioning tube, and has a tapered upper end portion extendible through the top opening and a radial pin hole aligned with the slot. A biasing spring biases the retaining member upwardly so that pull ropes which extend through the positioning tube can be clamped between the tapered upper end portion and the positioning tube. An elongated sleeve disposed around the positioning tube is formed with a radial hole that is aligned with the pin hole, and is provided with at least one hook projection for hooking end portions of the pull ropes thereon. An insert pin extends through the radial hole, the slot and into the pin hole. The elongated sleeve is movable downwardly relative to the positioning tube so as to retract the tapered upper end portion into the positioning tube for releasing the pull ropes.

4 Claims, 8 Drawing Sheets

OPERATING DEVICE FOR A VENETIAN BLIND TO CONTROL RAISING AND LOWERING OF THE SALTS AND TO ADJUST TILTING ANGLE OF THE SLATS

BACKGROUND OF THE INVENTION

1. Field of the Invention

The present invention relates to an operating device for a Venetian blind to control raising and lowering of the slats and to adjust tilting angle of the slats, more particularly to an operating device which conceals major portions of the pull ropes and which prevents access of children to the pull ropes.

2. Description of the Related Art

Referring to FIG. 1, a conventional Venetian blind includes an elongated housing 1, a horizontally disposed shaft 2 journalled in the housing 1, a plurality of slats 5 suspended one above another from the housing 1, a bottom rail 7 disposed below the slats 5, a pair of pulleys 3 provided on two end portions of the shaft 2, a lock unit 8 provided at one end of the housing 1, a tilt control unit 9, two pairs of tilting cords 4, and a pair of pull ropes 6. Each of the tilting cords 4 is disposed at a longitudinal side of each of the slats 5 and has a top end secured to one of the pulleys 3 and a bottom end secured to the bottom rail 7 so that rotation of the shaft 2 can cause the tilting cords 4 to move up and down in order to tilt the slats 5. Each of the slats 5 has two end portions, each of which is formed with a through hole 5*a*. Each of the pull ropes 6 has a first end passing through the vertically aligned through holes 5*a* formed in the slats 5 and secured to the bottom rail 7, and a second end passing through the housing 1 and the lock unit 8 and extending out of the housing 1. Referring to FIG. 2, the lock unit 8 is shown to include a stationary wheel 8*a* and a movable wheel 8*b*. The pull ropes 6 pass between the stationary wheel 8*a* and the movable wheel 8*b*, and are operable to move the movable wheel 8*b* toward the stationary wheel 8*a* so as to lock the pull ropes 6 and to position the slats 5, or away from the stationary wheel 8*a* so as to release the pull ropes 6 and to permit raising or lowering of the slats 5. Referring to FIG. 3, the tilt control unit 9 includes a worm 9*a* mounted securely on the shaft 2 and a worm gear 9*b* engaging the worm 9*a*. A rotating rod 9*c* is connected to the worm gear 9*b* so that the worm gear 9*b* is rotatable together with the rotating rod 9*c*, thereby causing corresponding rotation of the worm 9*a* and the shaft 2 to tilt the slats 5.

The aforementioned Venetian blind achieves the purposes of raising and lowering the slats 5 and adjusting the tilting angle of the slats 5 to control passage of light through the Venetian blind. However, the relatively long pull ropes 6 of the Venetian blind are always exposed and extend downwardly toward the ground. Children can easily access the pull ropes 6 and might be accidentally strangled by the same. Therefore, the conventional Venetian blind is not safe to use.

Moreover, in the conventional Venetian blind, the tilt control unit 9 for controlling tilting of the slats 5 is separate from the lock unit 8 for controlling raising and lowering of the slats 5. The conventional Venetian blind is thus inconvenient to operate and has a disorderly appearance.

Referring to FIG. 4, another conventional operating device is shown to include a tilt control unit having a first bevel gear 2*a* provided on the shaft of the Venetian blind and a second bevel gear 2*b* engaging the first bevel gear 2*a*. The second bevel gear 2*b* is formed with an axial hole 2*b*' to permit extension of the pull ropes 65 of the Venetian blind therethrough. A universal joint 55 is connected to a lower end of the second bevel gear 2*b*. An elongated sleeve 45 has one end connected to the universal joint 55 in such a manner that axial rotation of the elongated sleeve 45 results in corresponding axial rotation of the shaft of the Venetian blind so as to tilt the slats (not shown). A retaining unit 90 is provided at a lower end of the elongated sleeve 45 and includes a positioning tube 91, a biasing spring 92, a retaining member 93 and an outer sleeve 94. The pull ropes 65 extend out of the elongated sleeve 45 and pass through the positioning tube 91. The biasing spring 92 biases the outer sleeve 94 upwardly so that the pull ropes 65 are clamped tightly between the retaining member 93 and the positioning tube 91. The outer sleeve 94 is movable downwardly relative to the elongated sleeve 45 to compress the biasing spring 92 so as to release the pull ropes 65 and permit raising and lowering of the slats.

Although the aforementioned operating device offers the advantage of combining the functions of controlling raising and lowering of the slats and adjusting tilting angle of the slats in a single structure, the operating device still cannot fully obviate the problem of user safety since major portions of the pull ropes remain extended and exposed from the operating device.

SUMMARY OF THE INVENTION

The main object of the present invention is to provide an operating device which is capable of controlling raising and lowering of slats and the tilting angle of the slats of a Venetian blind, and which is capable of concealing major portions of the pull ropes of the Venetian blind therein.

Accordingly, the operating device of the present invention is used for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a pair of pull ropes, each of the pull ropes having a first end portion which passes through the housing and through the slats and which is mounted to the bottom rail, and a second end portion which extends out of the housing, two pairs of tilting cords, each of the pairs of tilting cords being disposed on a respective one of the opposite longitudinal sides of the slats and having an upper end secured to the shaft and a lower end mounted on the bottom rail, and a plurality of suspending strings disposed below each of the slats and connecting one of the pairs of tilting cords to the other one of the pairs of tilting cords. The operating device includes a rotary tilt control unit, a positioning tube, a retaining member, a biasing spring, an elongated sleeve and an insert pin.

The rotary tilt control unit has first and second ends. The first end is adapted to be coupled to the shaft of the Venetian blind such that axial rotation of the tilt control unit results in corresponding axial rotation of the shaft to adjust tilting angles of the slats.

The positioning tube is connected to the second end of the tilt control unit, and has a top wall formed with a top opening and a surrounding wall extending downwardly from a periphery of the top wall. The top wall and the surrounding wall cooperatively confine a receiving space. The top opening is adapted to permit extension of the second end portions of the pull ropes through the positioning tube. The surrounding wall has an axially extending slot unit formed therethrough.

The retaining member is axially movable in the receiving space of the positioning tube. The retaining member has a tapered upper end portion which is extendible through the top opening of the positioning tube, a hollow lower end portion and a radial pin hole aligned with the slot unit. The retaining member is provided with a pair of axially extending guiding grooves for receiving the pull ropes. Each of the guiding grooves has a depth not greater than diameter of each of the pull ropes.

The biasing spring is disposed in the positioning tube under the retaining member for biasing the retaining member upwardly so that the pull ropes can be clamped between the tapered upper end portion of the retaining member and the top wall of the positioning tube.

The elongated sleeve is disposed around the positioning tube and is formed with a radial hole aligned with the pin hole of the retaining member. The elongated sleeve has a length sufficient to conceal major sections of the second end portions of the pull ropes that extend out of the positioning tube. The elongated sleeve further has an outer surface with at least one hook projection adapted for hooking the second end portions of the pull ropes that extend out of the elongated sleeve thereon.

The insert pin extends through the radial hole of the elongated sleeve, the slot unit of the positioning tube and into the pin hole of the retaining member.

The elongated sleeve is movable downwardly relative to the positioning tube so that the insert pin and the retaining member are moved downwardly against biasing action of the biasing spring together with the elongated sleeve, thereby retracting the tapered upper end portion of the retaining member into the positioning tube for releasing the pull ropes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

The operating device of the present invention is adapted for use with a conventional Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a pair of pull ropes, each of which has a first end portion that passes through the housing and through the slats and that is mounted to the bottom rail, and a second end portion that extends out of the housing, two pairs of tilting cords, each of which is disposed on a respective one of the opposite longitudinal sides of the slats and has an upper end secured to the shaft and a lower end mounted on the bottom rail, and a plurality of suspending strings disposed below each of the slats for connecting one of the pairs of tilting cords to the other one of the pairs of tilting cords.

Figure 5:
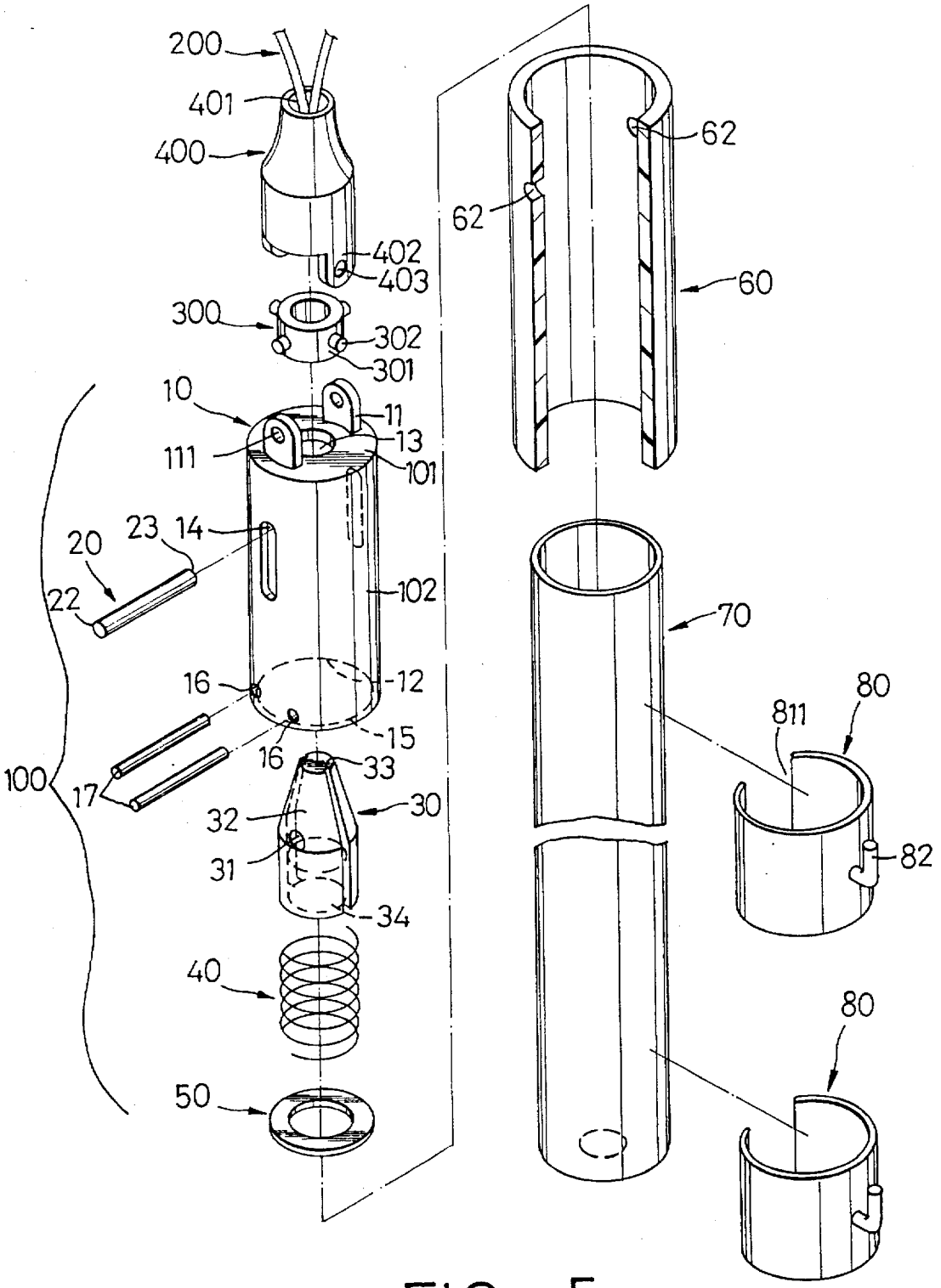
FIG. 5 is an exploded perspective view illustrating an operating device according to a preferred embodiment of the present invention.
Figure 6:
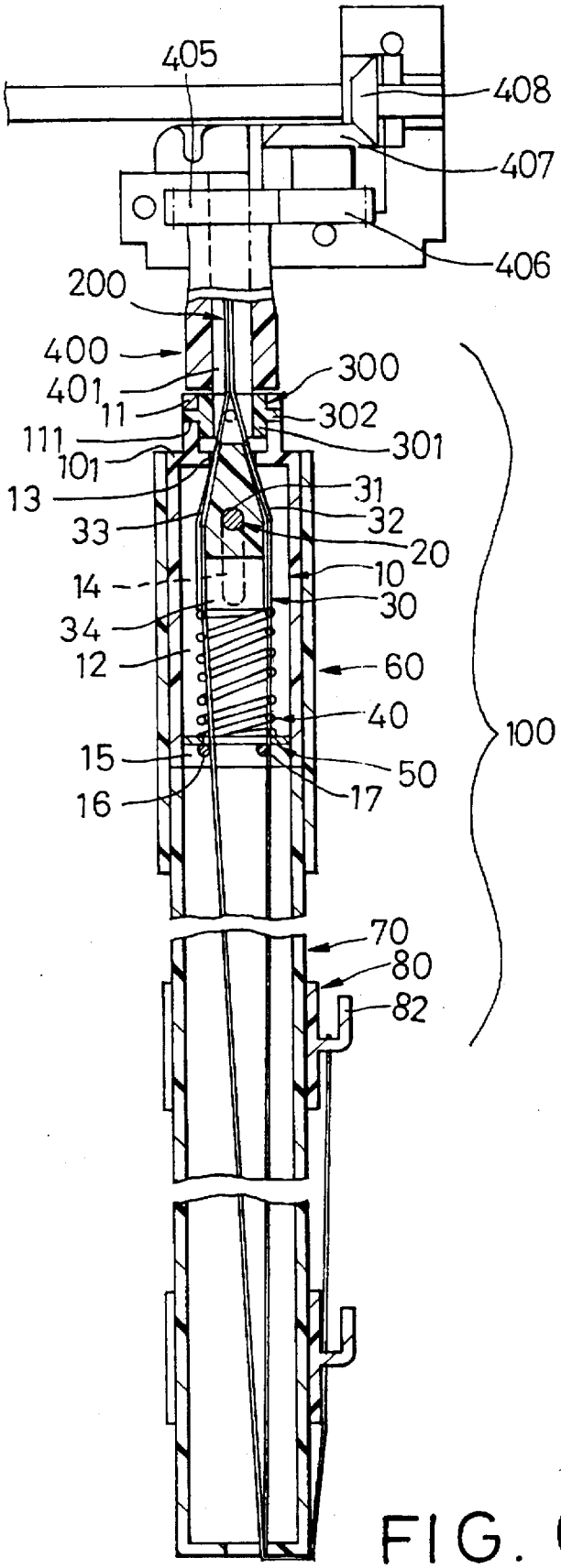
FIG. 6 is a front, vertical sectional view illustrating the operating device of the preferred embodiment.

Referring to FIGS. 5 and 6, the operating device 100 according to a preferred embodiment of the present invention includes a tilt control unit with a tubular connector 400 that has an upper end coupled to a first gear 405 which, in turn, engages a second gear 406. Both the first and second gears 405, 406 are rotatable about a vertical axis. The second gear 406 is coupled to a horizontal bevel gear 407 which is rotatable about a vertical axis and which engages a vertical bevel gear 408 that is sleeved rigidly on the shaft of the Venetian blind so that the shaft is rotatable together with the vertical bevel gear 408. Therefore, axial rotation of the tubular connector 400 can result in corresponding axial rotation of the shaft so as to adjust tilting angle of the slats of the Venetian blind. The tubular connector 400 has an axial hole 401 formed therethrough to permit passage of the pull ropes 200 therethrough. The tubular connector 400 has a lower end formed with a pair of diametrically opposed lobes 402, each of which is formed with a pivot hole 403 therethrough.

A positioning tube 10 is connected to the lower end of the tubular connector 400 by means of an annular joint 300. The annular joint 300 includes a ring 301 formed with four angularly spaced radial protrusions 302. An opposite pair of the radial protrusions 302 extend respectively through the pivot holes 403 of the tubular connector 400. The positioning tube 10 has a top wall 101 formed with a pair of upwardly extending, diametrically opposed lobes 11, each of which has a pivot hole 111 formed therethrough. The other opposite pair of the radial protrusions 302 of the annular joint 300 extend respectively through the pivot holes 111 of the positioning tube 10. Therefore, a universal joint is formed between the positioning tube 10 and the tubular connector 400. The positioning tube 10 can thus be connected pivotally to the lower end of the tubular connector 400. The top wall 101 of the positioning tube 10 is formed with a top opening 13 which is located between the pair of lobes 11. The top opening 13 permits extension of the second end portions of the pull ropes 200 through the positioning tube 10. The positioning tube 10 further has a surrounding wall 102 which extends downwardly from a periphery of the top wall 101. The top wall 101 and the surrounding wall 102 cooperatively confine a receiving space 12 with a bottom opening 15. The surrounding wall 102 has a pair of diametrically opposed, axially extending slots 14 formed therethrough. The slots 14 have a predetermined length and are registered with one another. The surrounding wall 102 is further formed with a pair of positioning holes 16 adjacent to the bottom opening 15. A pair of positioning pins 17 extend respectively through the positioning holes 16 and across the bottom opening 15 of the positioning tube 10.

A retaining member 30, which is substantially cylindrical in shape, is received in the receiving space 12 of the positioning tube 10 and is axially movable in the positioning tube 10. The retaining member 30 has a tapered upper end portion 32 which is extendible through the top opening 13 of the positioning tube 10, a hollow lower end portion formed with a cavity 34 therein, and a radial pin hole 31 formed therethrough. The retaining member 30 has an outer surface provided with a pair of axially extending guiding grooves 33 on two sides thereof for receiving the pull ropes 200. Each of the guiding grooves 33 has a depth not greater than the diameter of each of the pull ropes 200 so that the pull ropes 200 protrude radially from the retaining member 30 when received in the guiding grooves 33. Each of the guiding grooves 33 has a lower section communicated with the cavity 34 so that the pull ropes 200 can be guided inwardly into the cavity 34.

A biasing spring 40, such as a coiled compression spring, is disposed in the receiving space 12 of the positioning tube 10 immediately under the retaining member 30. The biasing spring 40 has an upper end abutting against a rim portion defining the cavity 34 of the retaining member 30 for biasing the retaining member 30 upwardly so that the tapered upper end portion 32 of the retaining member 30 extends through the top opening 13 formed in the top wall 101 of the positioning tube 10 and so that the pull ropes 200, which extend through the top opening 13, can be clamped tightly between the tapered upper end portion 32 of the retaining member 30 and the top wall 101 of the positioning tube 10. A washer 50 is provided between the biasing spring 40 and the pair of positioning pins 17. The biasing spring 40 has a lower end abutting against the washer 50.

The operating device 100 further has an elongated sleeve. In this embodiment, the elongated sleeve includes an upper sleeve section 60 and a lower sleeve section 70 which is secured to a lower end of the upper sleeve section 60. The upper sleeve section 60 is disposed around the positioning tube 10 and is formed with a pair of diametrically opposed radial holes 62 which are aligned with the pin hole 31 of the retaining member 30. The combined length of the upper and lower sleeve sections 60, 70 is sufficient to conceal major sections of the second end portions of the pull ropes 200 that extend out of the positioning tube 10. The lower sleeve section 70 is provided with two retaining rings 80 which are sleeved movably on an outer surface of the lower sleeve section 70. Each of the retaining rings 80 has a C-shaped cross-section and is formed with a notch 811 so as to be easily sleeved on the lower sleeve section 70 from one side of the latter. Each of the retaining rings 80 is formed with a hook projection 82 for hooking end portions of the pull ropes 200 that extend out of the lower sleeve section 70 thereon.

An insert pin 20 extends through the radial holes 62 of the upper sleeve section 60, the slots 14 of the positioning tube 10, and into the pin hole 31 of the retaining member 30. The insert pin 20 has two opposite ends 22, 23 which extend out of the positioning tube 10 and into the radial slots 62 of the upper sleeve section 60 (see FIG. 6) so that the positioning tube 10 is rotatable together with the upper sleeve section 60.

Figure 7:
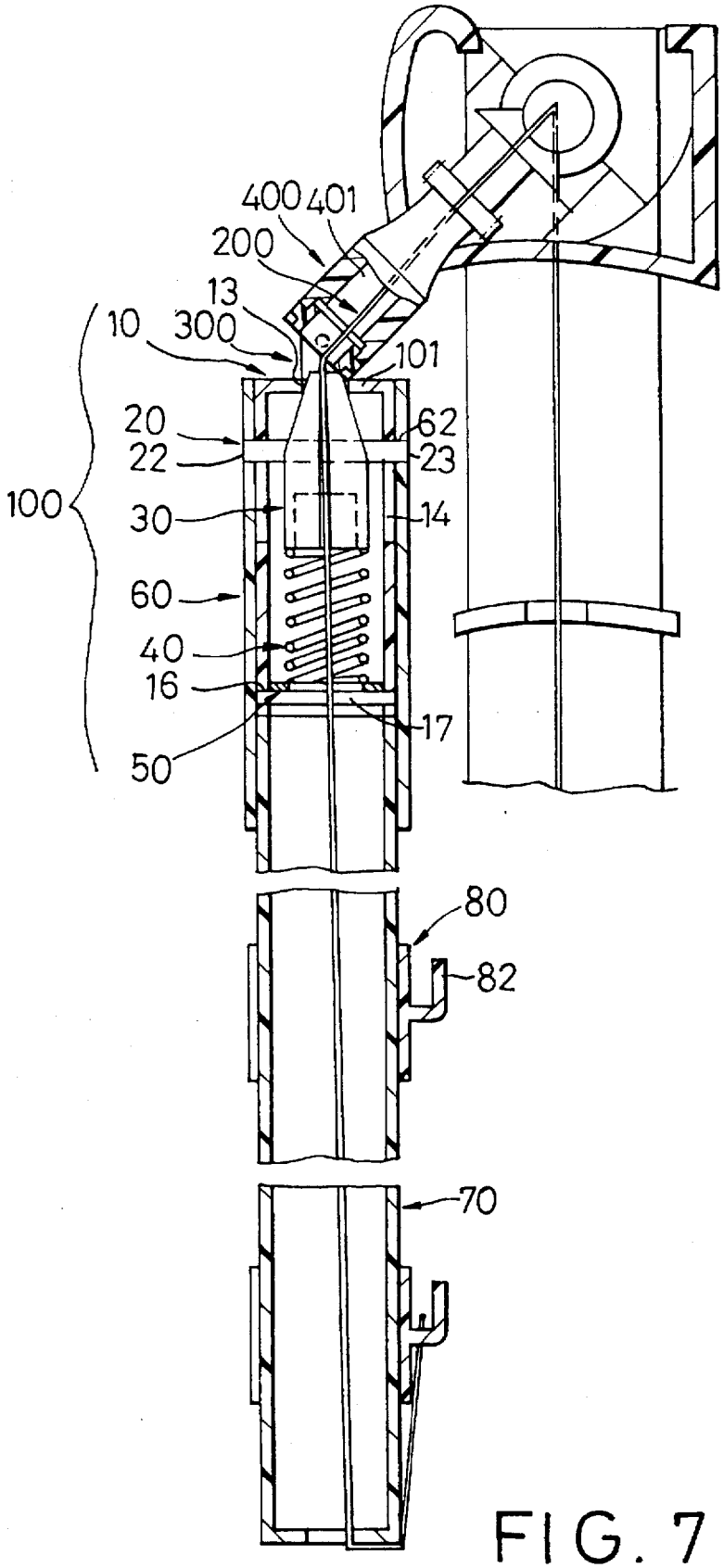
FIG. 7 is a side, vertical sectional view illustrating the operating device of the preferred embodiment.

Referring to FIGS. 6 and 7, after the operating device has been installed on a Venetian blind, the pull ropes 200 pass through the axial hole 401 of the tubular connector 400, the top opening 13 of the positioning tube 10, the guiding grooves 33 and the cavity 34 of the retaining member 30, the biasing spring 40 and the washer 50, and extend out of the lower sleeve section 70 of the elongated sleeve. Normally, the retaining member 30 is biased upwardly by the biasing spring 40 so that the tapered upper end portion 32 of the retaining member 30 extends through the top opening 13 of the positioning tube 10. The pull ropes 200 are thus tightly clamped between the retaining member 30 and the top wall 101 of the positioning tube 10, thereby positioning the slats of the Venetian blind. At this time, the insert pin 20 is located at an upper end of the elongated slots 14 of the positioning tube 10.

Figure 8:
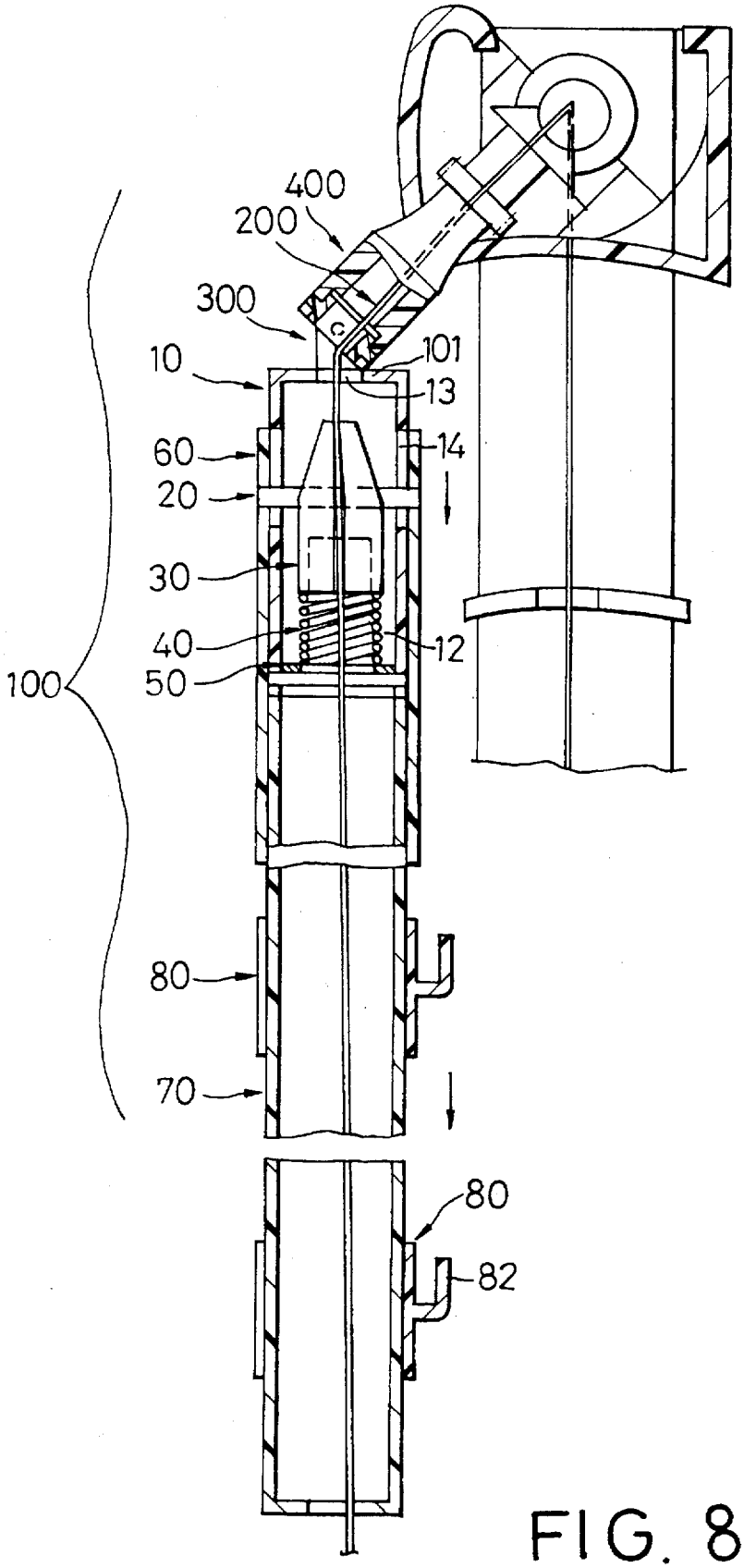
FIG. 8 is a side, vertical sectional view illustrating how the operating device is operated to control raising and lowering of the slats.

Referring to FIG. 8, when the lower sleeve section 70 is moved downwardly, thereby causing corresponding downward movement of the upper sleeve section 60, the insert pin 20 and the retaining member 30 are moved downwardly against biasing action of the biasing spring 40 together with the upper and lower sleeve sections 60, 70 relative to the positioning tube 10. The tapered upper end portion 32 is thus retracted into the receiving space 12 of the positioning tube 10, thereby releasing the pull ropes 200. The pull ropes 200 can thus be pulled down to raise the slats or be released to lower the slats. After the slats are adjusted to a desired position, the lower sleeve section 70 is released so that the retaining member 30 returns to its biased position. The tapered upper end portion 32 extends through the top opening 13 to once again clamp the pull ropes 200 tightly between the retaining member 30 and the top wall 101 of the positioning tube 10. The slats can thus be retained at the desired position. In case the slats are raised to expose a longer part of the pull ropes 200 out of the elongated sleeve, the exposed sections of the pull ropes 200 can be hooked on the hook projection 82 formed on an upper one of the retaining sleeves 80, as shown in FIG. 6. In case the slats are lowered to expose a shorter length of the pull ropes 200 out of the elongated sleeve, the exposed sections of the pull ropes 200 can be hooked on the hook projection 82 formed on a lower one of the retaining sleeves 80, as shown in FIGS. 7. Therefore, the second end portions of the pull ropes 200 do not extend downwardly toward the ground to prevent easy access by children thereto.

To adjust the tilting angle of the slats, the lower sleeve section 70 is rotated to rotate the upper sleeve section 60, the insert pin 20 and the positioning tube 10 simultaneously therewith. Since the positioning tube 10 is connected to the tubular connector 400 through the joint 300, the tubular connector 400 can be rotated axially, thereby causing corresponding axial rotation of the shaft so as to tilt the slats.

Figure 1:
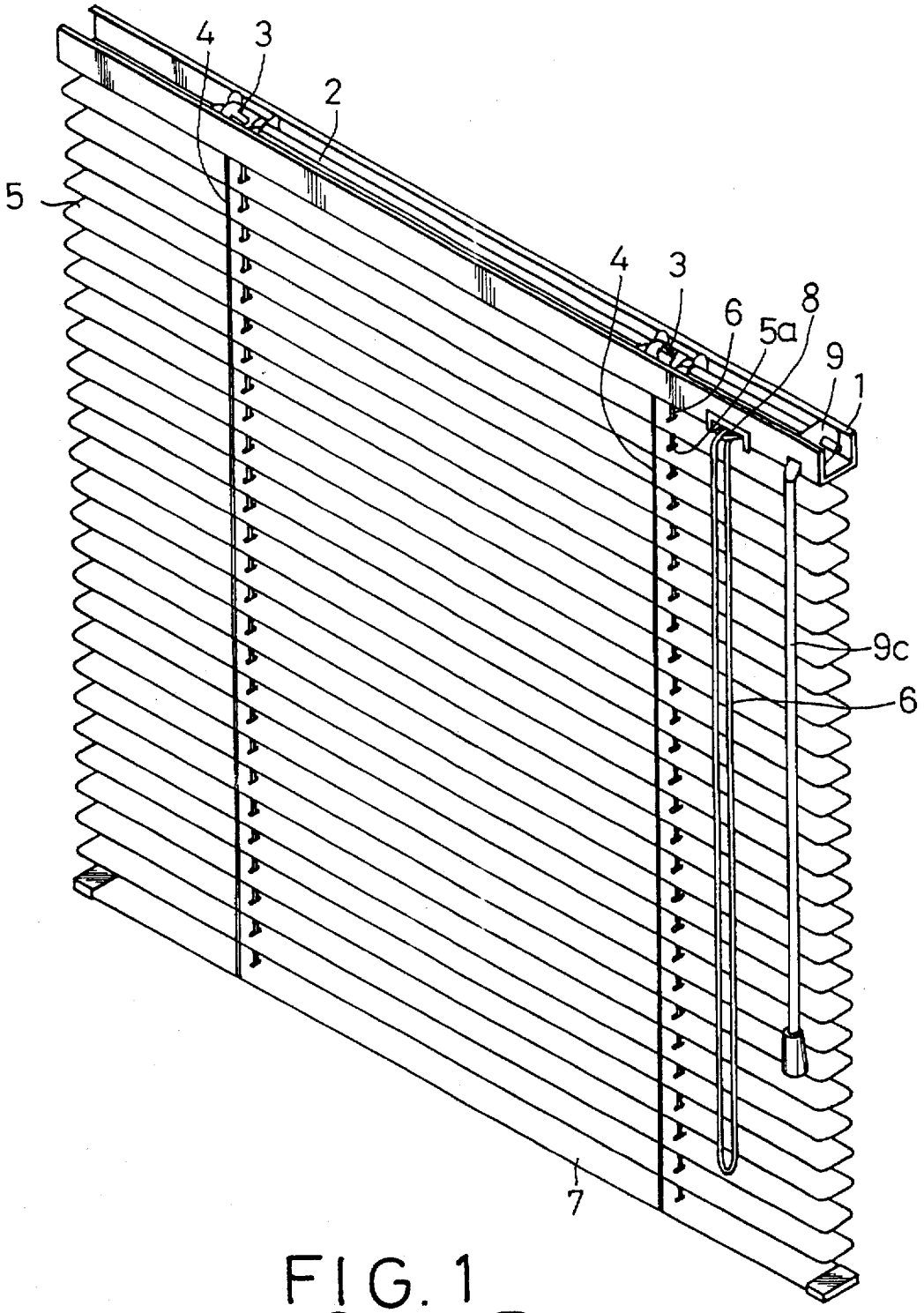
FIG. 1 PRIOR ART
FIG. 1 is a perspective view illustrating a conventional Venetian blind.
Figure 2:
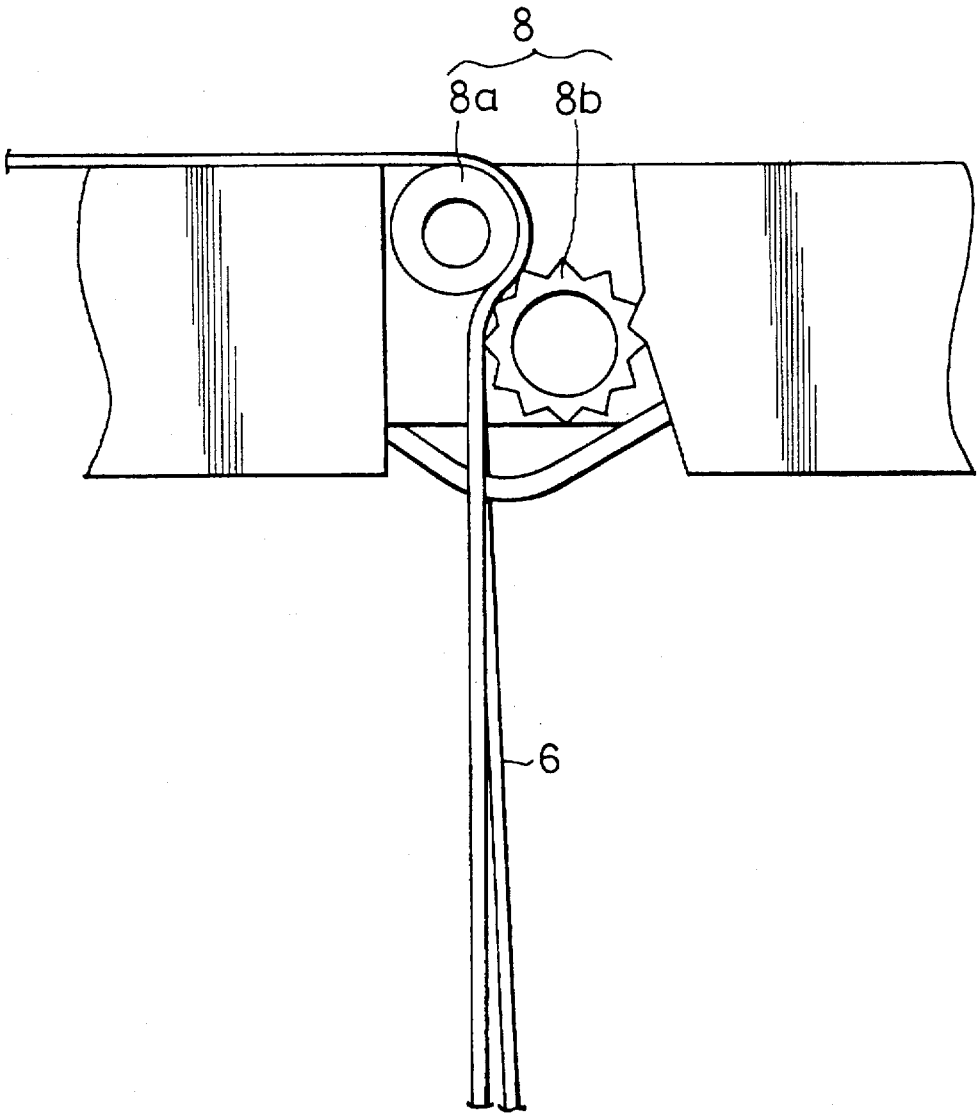
FIG. 2 PRIOR ART
FIG. 2 illustrates a lock unit of the conventional Venetian blind for locking pull ropes of the same.
Figure 3:
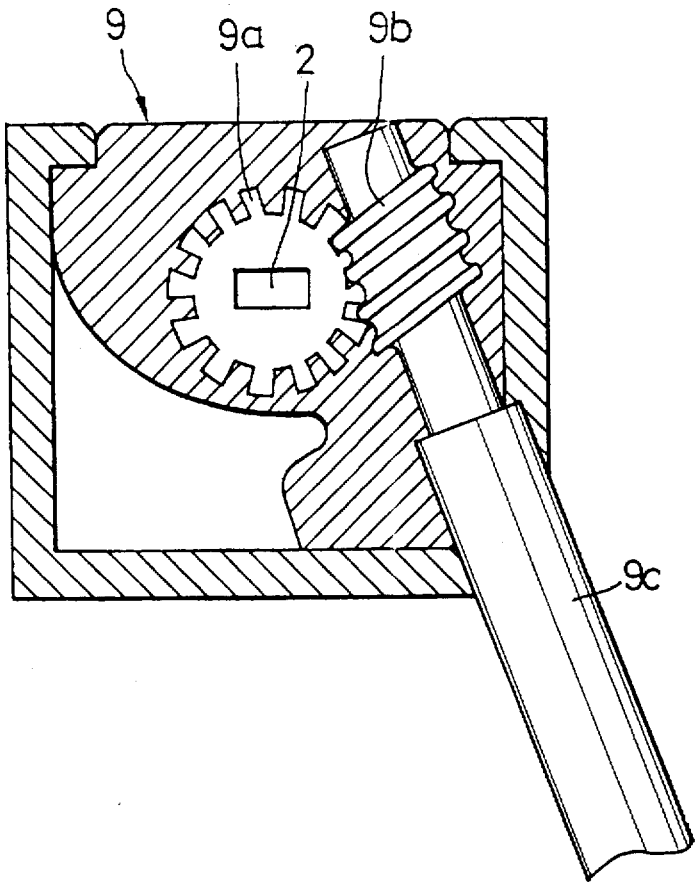
FIG. 3 PRIOR ART
FIG. 3 illustrates a tilt control unit of the conventional Venetian blind.
Figure 4:
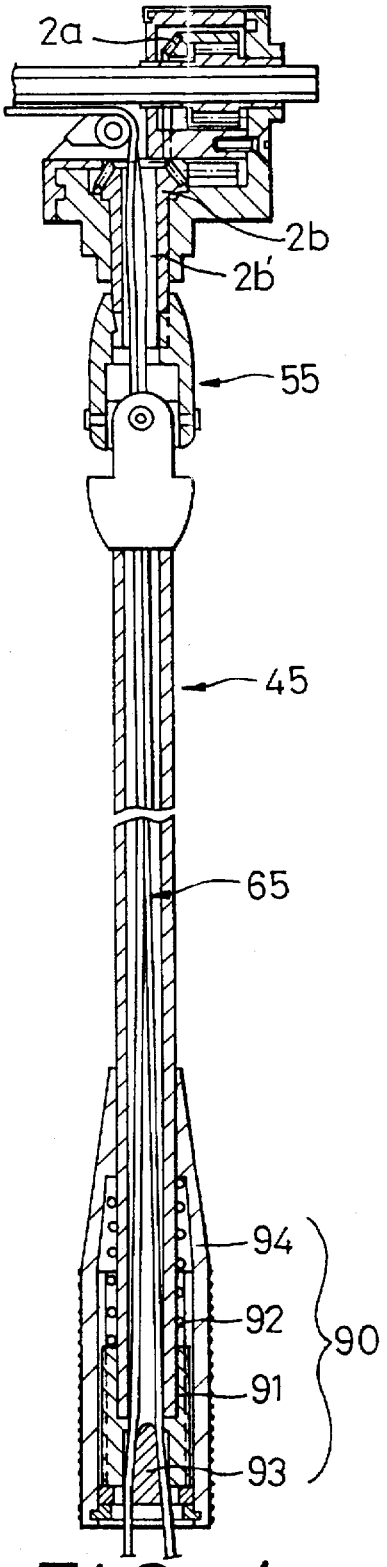
FIG. 4 PRIOR ART
FIG. 4 is a vertical sectional view illustrating a conventional operating device for controlling raising and lower of the slats and for adjusting tilting angle of the slats.

It should be noted that the specific structure of the tilt control unit would not be limited to the preferred embodiment. Other forms of tilt control units may be used as long as rotation of the tilt control unit results in corresponding axial rotation of the shaft. A conventional tilt control unit which includes a worm and a worm gear, as shown in FIG. 3, may also be modified for use in the present invention.

In addition, in this embodiment, the positioning tube 10 is formed with a pair of slots 14, while the upper sleeve section 60 is formed with a pair of radial holes 62. Alternatively, the positioning tube 10 may be formed with only one slot 14, while the upper sleeve section 60 may be formed with only one radial hole 62. In this case, the insert pin 20 is still extendible through the radial hole 62 of the upper sleeve section 60 and the slot 14 of the positioning tube 10 and into the pin hole 31 of the retaining member 30.

It has been shown that the operating device 100 of the present invention has combined functions of controlling raising and lowering of the slats and adjusting tilting angle of the slats and that the operating device 100 of the present invention is capable of concealing major sections of the pull ropes 200 so that the Venetian blind has an orderly appearance. Moreover, the exposed sections of the pull ropes 200 that extend out of the elongated sleeve can be hooked on one of the hook projections 82 to prevent access by children thereto. The object of the present invention is thus met.

With this invention thus explained, it is apparent that numerous modifications and variations can be made without departing from the scope and spirit of this invention. It is therefore intended that this invention be limited only as Indicated in the appended claims.

I claim:

1. An operating device for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a pair of pull ropes, each of the pull ropes having a first end portion which passes through the housing and through the slats and which is mounted to the bottom rail, and a second end portion which extends out of the housing, two pairs of tilting cords, each of the pairs of tilting cords being disposed on a respective one of the opposite longitudinal sides of the slats and having an upper end secured to the shaft and a lower end mounted on the bottom rail, and a plurality of suspending strings disposed below each of the slats and connecting one of the pairs of tilting cords to the other one of the pairs of tilting cords, said operating device comprising:

a rotary tilt control unit having first and second ends, said first end being adapted to be coupled to the shaft of the Venetian blind such that axial rotation of said tilt control unit results in corresponding axial rotation of the shaft to adjust tilting angles of the slats;

a positioning tube connected to said second end of said tilt control unit, said positioning tube having a top wall formed with a top opening and a surrounding wall extending downwardly from a periphery of said top wall, said top wall and said surrounding wall cooperatively confining a receiving space, said top opening being adapted to permit extension of the second end portions of the pull ropes through said positioning tube, said surrounding wall having an axially extending slot unit formed therethrough;

a retaining member axially movable in said receiving space of said positioning tube, said retaining member having a tapered upper end portion which is extendible through said top opening of said positioning tube, a hollow lower end portion and a radial pin hole aligned with said slot unit, said retaining member being provided with a pair of axially extending guiding grooves for receiving the pull ropes, each of said guiding grooves having a depth not greater than diameter of each of the pull ropes;

a biasing spring disposed in said positioning tube under said retaining member for biasing said retaining member upwardly so that the pull ropes can be clamped between said tapered upper end portion of said retaining member and said top wall of said positioning tube;

an elongated sleeve disposed around said positioning tube and formed with a radial hole aligned with said pin hole of said retaining member, said elongated sleeve having a length sufficient to conceal major sections of the second end portions of the pull ropes that extend out of said positioning tube, said elongated sleeve further having an outer surface with at least one hook projection adapted for hooking the second end portions of the pull ropes that extend out of said elongated sleeve thereon; and an insert pin extending through said radial hole of said elongated sleeve, said slot unit of said positioning tube and into said pin hole of said retaining member;

said elongated sleeve being movable downwardly relative to said positioning tube so that said insert pin and said retaining member are moved downwardly against biasing action of said biasing spring together with said elongated sleeve, thereby retracting said tapered upper end portion of said retaining member into said positioning tube for releasing the pull ropes.

2. The operating device according to claim 1, wherein said positioning tube is connected pivotally to said second end of said tilt control unit.

3. The operating device according to claim 1, further comprising at least one movable retaining ring which is sleeved movably on said elongated sleeve and which has said hook projection formed thereon.

4. The operating device according to claim 1, further comprising:

a first gear coupled to said first end of said rotary tilt control unit and having a first vertical axis;

a second gear engaging said first gear and having a second vertical axis parallel to said first vertical axis;

a horizontal bevel gear coupled to said second gear and coaxial with said second vertical axis; and a vertical bevel gear adapted to be coupled to the shaft of the Venetian blind and engaging said horizontal bevel gear.

* * * * *